US010238204B2

(12) United States Patent
Lee et al.

(10) Patent No.: US 10,238,204 B2
(45) Date of Patent: Mar. 26, 2019

(54) ORAL CARE IMPLEMENT

(71) Applicant: COLGATE-PALMOLIVE COMPANY, New York, NY (US)

(72) Inventors: David Kyung Min Lee, East Brunswick, NJ (US); Robert Moskovich, East Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 452 days.

(21) Appl. No.: 15/034,275

(22) PCT Filed: Nov. 5, 2013

(86) PCT No.: PCT/US2013/068526
§ 371 (c)(1),
(2) Date: May 4, 2016

(87) PCT Pub. No.: WO2015/069219
PCT Pub. Date: May 14, 2015

(65) Prior Publication Data

US 2016/0270520 A1 Sep. 22, 2016

(51) Int. Cl.
*A46B 9/02* (2006.01)
*A46B 9/04* (2006.01)
(Continued)

(52) U.S. Cl.
CPC ..... *A46B 15/0081* (2013.01); *A46B 9/025* (2013.01); *A46B 9/04* (2013.01); *A46B 9/06* (2013.01); *A46B 2200/1066* (2013.01)

(58) Field of Classification Search
CPC ..... A46B 15/0081; A46B 9/025; A46B 9/026; A46B 9/028; A46B 9/04; A46B 9/06; A46B 2200/1066
See application file for complete search history.

(56) References Cited

U.S. PATENT DOCUMENTS 1,268,544 A 6/1918 Cates
D102,048 S 10/1935 Brothers et al.
(Continued)

FOREIGN PATENT DOCUMENTS

AU 2008200512 2/2008
AU 2011202491 A1 6/2011
(Continued)

OTHER PUBLICATIONS

International Search Report and the Written Opinion of the International Searching Authority issued in International Patent Application PCT/US2013/068526 dated Jul. 31, 2014.

*Primary Examiner* — Weilun Lo

(57) ABSTRACT

An oral care implement is provided comprising a head comprising a first face having a plurality of cleaning elements extending therefrom. The head has a length and a width perpendicular to the length. The head has a proximal section adjacent to the handle and a distal section remote from the handle, the proximal section having a first maximum width and the distal section having a second maximum width, wherein the second maximum width is less than the first maximum width. The distal and proximal sections are located adjacent to one another and are joined at a waist section that has a third maximum width which is less than the second maximum width. At least one bristle tuft having a distal end remote from the first face is provided that comprises bristles of varying lengths so as to form a cup-shaped recess at the distal end of the bristle tuft.

13 Claims, 8 Drawing Sheets

(51) Int. Cl.
*A46B 9/06* (2006.01)
*A46B 15/00* (2006.01)

(56) References Cited

U.S. PATENT DOCUMENTS 2,161,349 A 6/1939 Hadden
D274,018 S 5/1984 Usui
5,186,627 A 2/1993 Amit et al.
5,201,092 A 4/1993 Colson
D335,579 S 5/1993 Chuang
5,244,298 A 9/1993 Greenhouse
5,259,083 A 11/1993 Stansbury, Jr.
D347,943 S 6/1994 Perry
5,355,544 A 10/1994 Dirksing
D352,829 S 11/1994 Perry
5,371,915 A 12/1994 Key
D386,314 S 11/1997 Mokovich
D391,767 S 3/1998 Mokovich
5,742,972 A 4/1998 Bredall et al.
5,765,254 A 6/1998 O'Halloran
5,768,737 A 6/1998 Leutwyler et al.
5,781,958 A 7/1998 Meessmann et al.
D396,753 S 8/1998 Mokovich
5,797,158 A 8/1998 Hoshizaki et al.
5,802,656 A 9/1998 Dawson et al.
5,918,995 A 7/1999 Puurunen
5,926,898 A 7/1999 Kramer
5,926,900 A 7/1999 Bennett
5,956,796 A 9/1999 Lodato
5,991,959 A 11/1999 Raven et al.
6,009,589 A 1/2000 Driesen et al.
6,041,467 A 3/2000 Roberts et al.
6,041,468 A 3/2000 Chen et al.
6,101,659 A 8/2000 Halm
6,138,316 A 10/2000 Weihrauch
6,141,817 A 11/2000 Dawson
6,142,694 A 11/2000 Rivlin et al.
D434,906 S 12/2000 Beals et al.
6,202,241 B1 3/2001 Hassell et al.
D447,873 S 9/2001 Harries et al.
D450,929 S 11/2001 Angelini et al.
6,315,556 B1 11/2001 Stewart
6,321,407 B1 11/2001 Weihrauch
6,327,735 B1 12/2001 Kramer
6,357,074 B1 3/2002 Weihrauch
D455,557 S 4/2002 Roehrig
D456,136 S 4/2002 Roehrig
6,421,867 B1 7/2002 Weihrauch
6,446,295 B1 9/2002 Calabrese
D466,694 S 12/2002 Saindon et al.
6,553,604 B1 4/2003 Braun et al.
6,611,984 B1 9/2003 Halm
6,675,428 B2 1/2004 Hahn
6,832,819 B1 12/2004 Weihrauch
D502,603 S 3/2005 Seifert et al.
D507,114 S 7/2005 Seifert et al.
7,036,179 B1 5/2006 Weihrauch
7,146,675 B2 12/2006 Ansari et al.
7,168,125 B2 1/2007 Hohlbein
D549,462 S 8/2007 Blanchard et al.
D558,980 S 1/2008 Jimenez et al.
D559,546 S 1/2008 Wong
D562,560 S 2/2008 Hohlbein
7,334,286 B2 2/2008 Kayser
7,398,575 B2 7/2008 Chan
D577,493 S 9/2008 Wong
7,480,955 B2 1/2009 Hohlbein et al.
D589,260 S 3/2009 Hohlbein
D599,556 S 9/2009 Russell et al.
7,607,189 B2 10/2009 Moskovich
D603,170 S 11/2009 Wong
D614,869 S 5/2010 Wong
D615,761 S 5/2010 Wong
D621,621 S 8/2010 Winkler
D623,414 S 9/2010 Wagner
D630,020 S 1/2011 Wong
D634,934 S 3/2011 Kalbfeld et al.
D637,400 S 5/2011 Moskovich
D637,401 S 5/2011 Pusch et al.
8,091,170 B2 1/2012 Moskovich et al.
D666,005 S 8/2012 Winkler
D669,688 S 10/2012 Jimenez et al.
D670,503 S 11/2012 Jimenez et al.
8,484,789 B2 7/2013 Claire-Zimmet et al.
8,601,635 B2 12/2013 Goldman et al.
8,613,123 B2 12/2013 Pfenniger et al.
2002/0017003 A1 2/2002 Kramer et al.
2003/0077107 A1 4/2003 Kuo
2003/0229959 A1* 12/2003 Gavney, Jr. ..... A46B 9/005 15/117
2004/0025275 A1 2/2004 Moskovich et al.
2004/0134007 A1 7/2004 Davies
2005/0000049 A1* 1/2005 Hohlbein ..... A46B 9/026 15/111
2005/0015901 A1 1/2005 Gavney
2005/0224807 A1 10/2005 Ravi et al.
2005/0235439 A1 10/2005 Braun et al.
2006/0195995 A1* 9/2006 Moskovich ..... A46B 7/04 15/111
2007/0199168 A1 8/2007 Blanchard et al.
2008/0184511 A1* 8/2008 Brown ..... A46B 7/02 15/110
2008/0201884 A1 8/2008 Vazquez et al.
2009/0229063 A1 9/2009 Merl et al.
2010/0043162 A1 2/2010 Zimmermann et al.
2010/0101035 A1 4/2010 Nakamura
2011/0030160 A1 2/2011 Knutzen et al.
2011/0047736 A1* 3/2011 Jimenez ..... A46B 9/04 15/167.2
2011/0138560 A1 6/2011 Vitt et al.
2011/0146014 A1* 6/2011 Jimenez ..... A46B 9/04 15/167.1
2011/0214240 A1* 9/2011 Jimenez ..... A46B 11/001 15/167.1
2011/0219558 A1 9/2011 Vitt et al.
2011/0308029 A1* 12/2011 Edelstein ..... A46B 5/026 15/167.1
2012/0174328 A1 7/2012 Moskovich
2012/0266400 A1* 10/2012 Jimenez ..... A46B 9/04 15/105
2013/0255017 A1 10/2013 Lee
2013/0276252 A1* 10/2013 Xi ..... A46B 5/0029 15/105
2015/0150367 A1* 6/2015 Moskovich ..... A46B 9/04 15/167.1
2016/0262532 A1* 9/2016 Lee ..... A46B 9/04
2016/0270519 A1* 9/2016 Lee ..... A46B 9/04

FOREIGN PATENT DOCUMENTS

AU 2012202136 5/2012
CA 2163314 6/1996
CN 201911545 8/2011
CN 301763519 8/2011
CN 301908826 10/2011
CN 302058056 3/2012
CN 202618766 12/2012
DE 2930459 2/1981
DE 4303431 8/1993
EM 000097415-0005 11/2003
EM 000992961-0001 8/2008
EM 000992979-0001 8/2008
EP 2298124 A1 3/2011
EP 2 656 815 10/2013
IN 197952 3/2005
IN 211111 4/2005
IN 201869 9/2005
IN 218180 3/2006
IN 221837 7/2006
IN 208416 10/2006
IN 240227 6/2007
IN 2896/DELNP/2007 8/2007
IN 215636 8/2007

(56) References Cited

FOREIGN PATENT DOCUMENTS

| | | | |
|---|---|---|---|
| IN | 1479/DELNP/2009 | | 6/2009 |
| IN | 4656/CHENP/2010 | | 4/2011 |
| KR | 20040077155 | A | 9/2004 |
| KR | 20070014929 | | 2/2007 |
| RU | D49356 | | 10/2001 |
| RU | D57329 | | 8/2005 |
| RU | D75349 | | 7/2010 |
| RU | D76849 | | 12/2010 |
| RU | D80641 | | 1/2012 |
| RU | 120342 | | 9/2012 |
| WO | WO94/09678 | | 5/1994 |
| WO | WO94/10539 | | 5/1994 |
| WO | WO95/06420 | | 3/1995 |
| WO | WO96/02165 | | 2/1996 |
| WO | WO97/07707 | | 3/1997 |
| WO | WO98/27846 | | 7/1998 |
| WO | WO99/23910 | | 5/1999 |
| WO | WO99/49754 | | 10/1999 |
| WO | WO99/65358 | | 12/1999 |
| WO | WO2000/74522 | | 12/2000 |
| WO | WO2000/76369 | | 12/2000 |
| WO | WO01/12013 | | 2/2001 |
| WO | WO2001/015567 | | 3/2001 |
| WO | WO2001/29128 | | 4/2001 |
| WO | WO01/43584 | | 6/2001 |
| WO | WO2001/45573 | | 6/2001 |
| WO | WO03/055351 | | 7/2003 |
| WO | WO2004/056235 | | 7/2004 |
| WO | WO2005/112794 | | 12/2005 |
| WO | WO2007/104351 | | 9/2007 |
| WO | WO2009/000903 | | 12/2008 |
| WO | WO2009/072747 | | 6/2009 |
| WO | WO2010/069917 | | 6/2010 |
| WO | WO2010/069919 | | 6/2010 |
| WO | WO2011/070549 | | 6/2011 |
| WO | WO2011/073912 | | 6/2011 |
| WO | WO2011/084116 | | 7/2011 |
| WO | WO2011/159931 | | 12/2011 |

* cited by examiner

ORAL CARE IMPLEMENT

CROSS-REFERENCE TO RELATED PATENT APPLICATIONS

This application is a U.S. national stage application under 35 U.S.C. § 371 of PCT Application No. PCT/US2013/068526, filed Nov. 5, 2013, the entirety of which is incorporated herein by reference.

BACKGROUND

Various toothbrushes are known in the art which have a variety of head constructions and arrangements of cleaning elements. However, it would be desirable to provide a toothbrush which is able to provide effective cleaning of hard-to-reach areas in the mouth, including the back teeth.

BRIEF SUMMARY

The present invention provides an oral care implement comprising a head and a handle, the head comprising a first face having a plurality of cleaning elements extending therefrom, wherein the head has a length in a direction along a longitudinal axis of the handle, and a width perpendicular to the length, the head having a proximal section adjacent to the handle and a distal section remote from the handle, the proximal section having a first maximum width and the distal section having a second maximum width, wherein the second maximum width is less than the first maximum width, wherein the distal section and proximal section are located adjacent to one another and are joined at a waist section, the waist section having a third maximum width which is less than the second maximum width, the plurality of cleaning elements comprising at least one bristle tuft having a distal end remote from the first face, wherein the at least one bristle tuft comprises bristles of varying lengths so as to form a cup-shaped recess at the distal end of the bristle tuft.

Optionally, the at least one bristle tuft is a cylindrical bristle tuft.

Optionally, the ratio of the first maximum width to the second maximum width is from 1.1:1 to 1.3:1. Further optionally, the ratio of the first maximum width to the second maximum width is from 1.17:1 to 1.21:1.

Optionally, the second maximum width is from 11.3 mm to 13.3 mm. Further optionally, the second maximum width is from 11.8 mm to 12.8 mm.

Optionally, the at least one bristle tuft is positioned on a longitudinal axis of the head. Further optionally, the plurality of cleaning elements further comprises at least one cleaning element which is substantially V-shaped in plan, and which has a concave side facing towards the bristle tuft.

Further optionally, the oral care implement comprises a plurality of said cleaning elements which are substantially V-shaped in plan, positioned in series on the longitudinal axis of the head wherein the concave side of each said cleaning element faces towards the bristle tuft. Still further optionally, each of the plurality of V-shaped cleaning elements has a height, wherein the height of successive V-shaped cleaning elements in the series increases with an increase in distance of the V-shaped cleaning elements from the bristle tuft.

Optionally, each V-shaped cleaning element has a height which is consistent along its extension across the width of the head.

Optionally, each V-shaped cleaning element has a height which decreases upon its extension across the width of the head away from the longitudinal axis of the head.

Optionally, each of the plurality of V-shaped cleaning elements is formed from an array of bristles.

Optionally, the oral care implement further comprises peripheral bristles positioned towards an outer edge of the first face of the head. Further optionally, the peripheral bristles have a height which increases with distance from the waist section. Still further optionally, at any given distance from the waist section along the length of the head, the height of the peripheral bristles is greater than the height of an adjacent one of the V-shaped cleaning elements.

Optionally, the peripheral bristles include a terminal bristle tuft positioned at a distal-most end of the distal section, wherein a distal-most surface of the terminal bristle tuft forms an angle of from 80° to 89° with a longitudinal axis of the head. Further optionally, the angle is from 84° to 87°.

Optionally, the height of the at least one bristle tuft is less than the height of the peripheral bristles adjacent thereto.

Optionally, the height of each peripheral bristle tuft increases along its extension along the head in a direction away from the waist section, so that distal ends of successive peripheral bristle tufts form a concave profile from the waist section to a distal-most end of the head, when viewed from the side of the oral care implement.

Optionally, the height of each peripheral bristle tuft increases along its extension along the head in a direction away from the waist section, so that distal ends of successive peripheral bristle tufts form a concave profile from the waist section to a proximal-most end of the head, when viewed from the side of the oral care implement.

Optionally, each peripheral bristle tuft has a height which is consistent along the extension of the peripheral bristle tuft along the head.

Optionally, the height of successive peripheral bristle tufts increases with their distance from the waist section Optionally, the oral care implement further comprises a first bristle tuft positioned on a longitudinal axis of the head in the proximal section of the head, and a second bristle tuft positioned on a longitudinal axis of the head in the distal section of the head, wherein each of the first and second bristle tufts have a distal end remote from the first face, and wherein each of the first and second bristle tufts comprise bristles of varying lengths so as to form a cup-shaped recess at the distal end of each of the first and second bristle tufts.

Optionally, the first and second bristle tufts are cylindrical bristle tufts.

Optionally, the oral care implement comprises a first plurality of cleaning elements which are substantially V-shaped in plan, positioned in series on the longitudinal axis of the head in the proximal section, wherein each of said first plurality of V-shaped cleaning elements has a concave side facing towards the first bristle tuft.

Optionally, the first bristle tuft is positioned towards the waist section and the first plurality of V-shaped cleaning elements are positioned between the first bristle tuft and a proximal-most end of the head.

Optionally, the oral care implement further comprises a second plurality of cleaning elements which are substantially V-shaped in plan, positioned in series on the longitudinal axis of the head in the distal section, wherein each of said second plurality of V-shaped cleaning elements has a concave side facing towards the second bristle tuft.

Optionally, the second bristle tuft is positioned towards the waist section and the second plurality of V-shaped cleaning elements are positioned between the second bristle tuft and a distal-most end of the head.

Optionally, each of the first plurality of V-shaped cleaning elements has a height, wherein the height of successive V-shaped cleaning elements in the series increases with an increase in distance of the first plurality of V-shaped cleaning elements from the first bristle tuft.

Optionally, each of the second plurality of V-shaped cleaning elements has a height, wherein the height of successive V-shaped cleaning elements in the series increases with an increase in distance of the second plurality of V-shaped cleaning elements from the second bristle tuft.

Optionally, the oral care implement comprises the first plurality of V-shaped cleaning elements and the second plurality of V-shaped cleaning elements, wherein the height of each of the second plurality of V-shaped cleaning elements is greater than the height of a corresponding one of the first plurality of V-shaped cleaning elements.

Optionally, each V-shaped cleaning element has a height which is consistent along its extension across the width of the head.

Optionally, each V-shaped cleaning element has a height which decreases upon its extension across the width of the head away from the longitudinal axis of the head.

Optionally, each of the plurality of V-shaped cleaning elements is formed from an array of bristles.

Optionally, the oral care implement further comprises peripheral bristles positioned towards an outer edge of the first face of the head. Further optionally, the peripheral bristles have a height which increases with distance from the waist section. Still further optionally, at any given distance from the waist section along the length of the head, the height of the peripheral bristles is greater than the height of an adjacent one of the V-shaped cleaning elements.

Optionally, the peripheral bristles include a terminal bristle tuft positioned at a distal-most end of the distal section, wherein a distal-most surface of the terminal bristle tuft forms an angle of from 80° to 89° with a longitudinal axis of the head. Further optionally, the angle is from 84° to 87°.

Optionally, the height of the first and second bristle tufts is less than the height of the peripheral bristles adjacent thereto.

Optionally, the oral care implement comprises first and second bristle tufts, first and second pluralities of V-shaped cleaning elements, and first and second pluralities of peripheral bristles, the first plurality of peripheral bristles being positioned on the proximal section of the head and the second plurality of peripheral bristles being positioned on the distal section of the head.

Optionally, the first plurality of peripheral bristles and the second bristle tuft are positioned on the head so as to form a first teardrop-shaped pattern when seen in plan view.

Optionally, the second plurality of peripheral bristles and the first bristle tuft are positioned on the head so as to form a second teardrop-shaped pattern when seen in plan view.

Optionally, the first teardrop-shaped pattern and the second teardrop-shaped pattern are interlocked when seen in plan view.

Optionally, the first plurality of peripheral bristles comprises a first plurality of peripheral bristle tufts and the second plurality of peripheral bristles comprises a second plurality of peripheral bristle tufts.

Optionally, the height of successive first peripheral bristle tufts increases with their distance from the second bristle tuft, and the height of successive second peripheral bristle tufts increases with their distance from the first bristle tuft.

Optionally, each peripheral bristle tuft has a height which is consistent along the extension of the peripheral bristle tuft along the head.

Optionally, the height of each first peripheral bristle tuft increases along its extension along the head in a direction away from the second bristle tuft, and the height of successive first peripheral bristle tufts increases with distance from the second bristle tuft so that distal ends of the plurality of first peripheral bristle tufts form a concave profile when viewed from the side of the oral care implement.

Optionally, the height of each second peripheral bristle tuft increases along its extension along the head in a direction away from the first bristle tuft, and the height of successive second peripheral bristle tufts increases with distance from the first bristle tuft so that distal ends of the plurality of second peripheral bristle tufts form a concave profile when viewed from the side of the oral care implement Optionally, the oral care implement further comprises a second face located on an opposite side of the head to the first face, wherein the second face comprises a tissue cleanser.

Optionally, the tissue cleanser extends over a distal-most edge of the head.

Optionally, the tissue cleanser forms a ridge on the distal-most edge of the head.

Optionally, the at least one ridge extends across the distal-most end of the head in a direction parallel to the width of the head.

Optionally, the ridge comprises at least one notch which divides the ridge into a plurality of sections across the width of the distal-most end of the head.

Optionally, the tissue cleanser extends past a proximal-most end of the head along a portion of the handle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
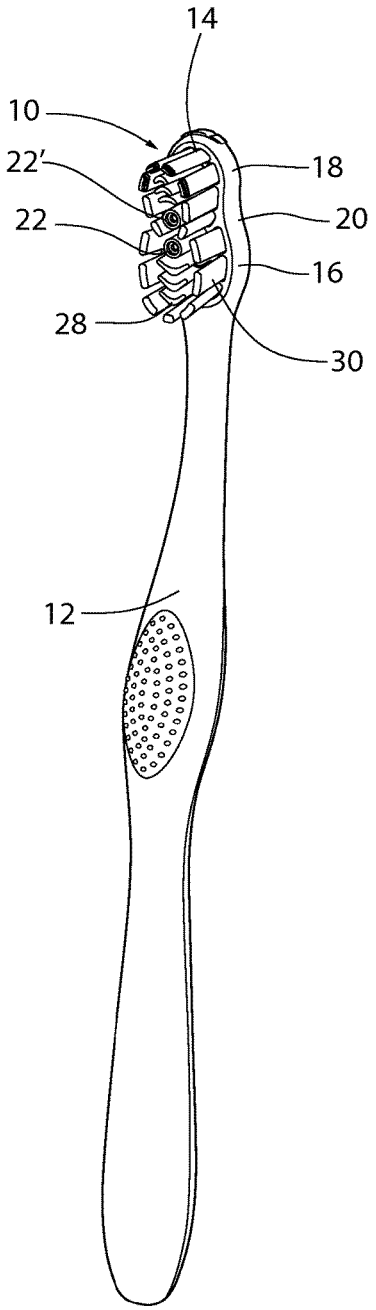
FIG. 1 illustrates a perspective view of a toothbrush in accordance with an embodiment of the present invention.
Figure 2:
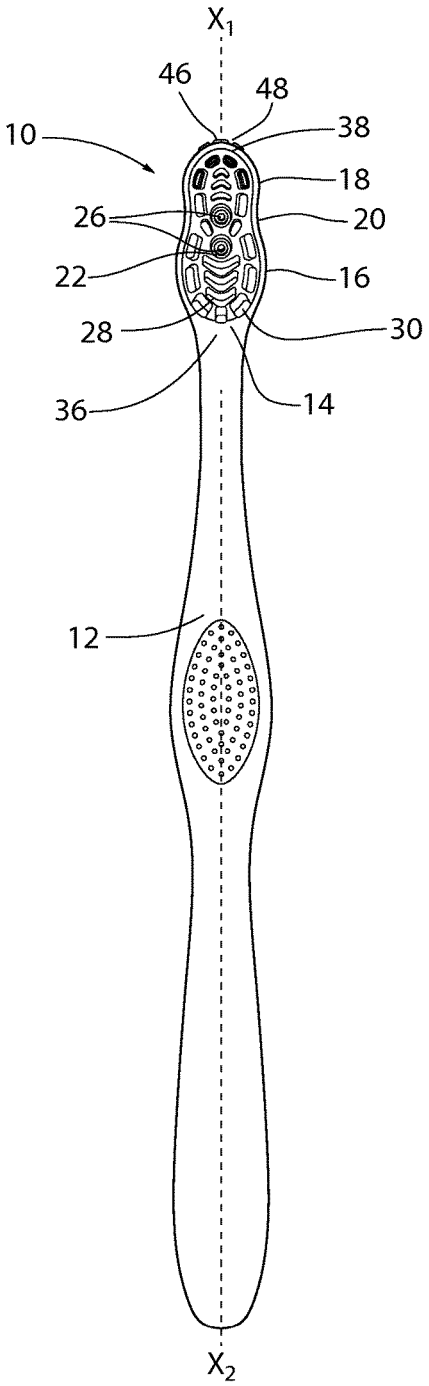
FIG. 2 illustrates a front view of the toothbrush of FIG. 1.
Figure 3A:
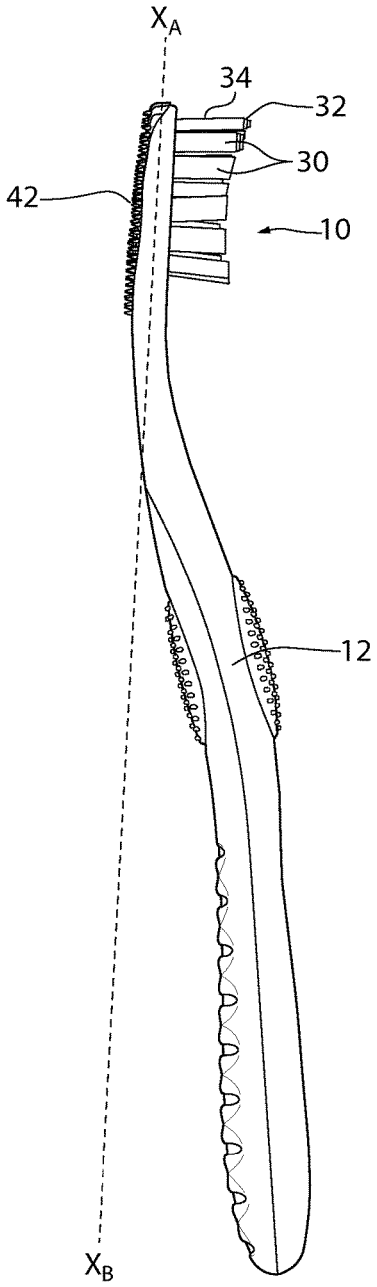
FIG. 3A illustrates the toothbrush of FIG. 2, viewed from the left-hand side thereof.
Figure 3B:
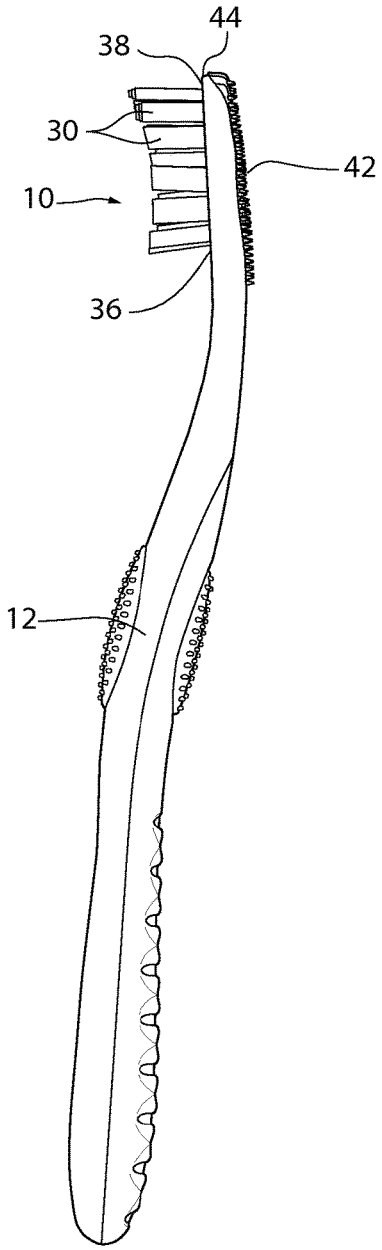
FIG. 3B illustrates the toothbrush of FIG. 2, viewed from the right-hand side thereof.
Figure 4A:
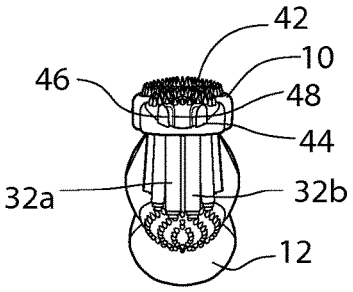
FIG. 4A illustrates a top view of the toothbrush of FIG. 3A, along the longitudinal axis $X_A$-$X_B$ of the head, looking in a direction from $X_A$ to $X_B$.
Figure 4B:
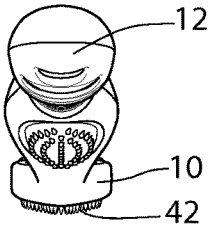
FIG. 4B illustrates a bottom view of the toothbrush of FIG. 3A, along the longitudinal axis $X_A$-$X_B$ of the head, looking in a direction from $X_B$ to $X_A$.
Figure 5:
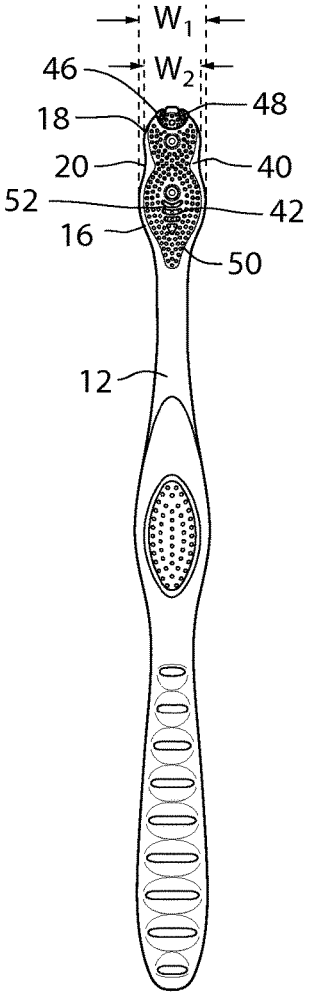
FIG. 5 illustrates a rear view of the toothbrush of FIG. 1.
Figure 6:
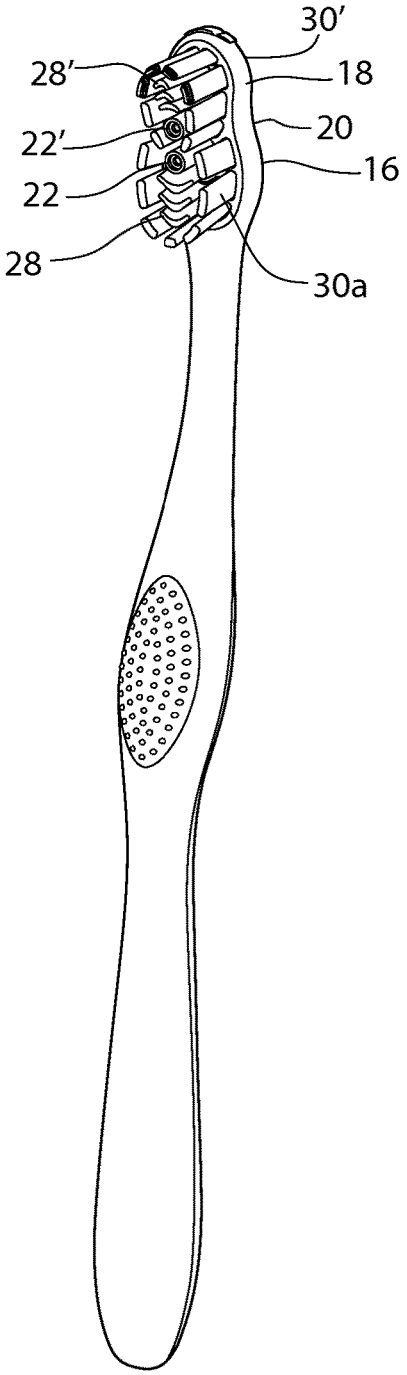
FIG. 6 illustrates a perspective view of the toothbrush of FIG. 1, with the first and second pluralities of peripheral bristle tufts, the first and second bristle tufts and the first and second pluralities of V-shaped cleaning elements differentiated by shading.
Figure 7:
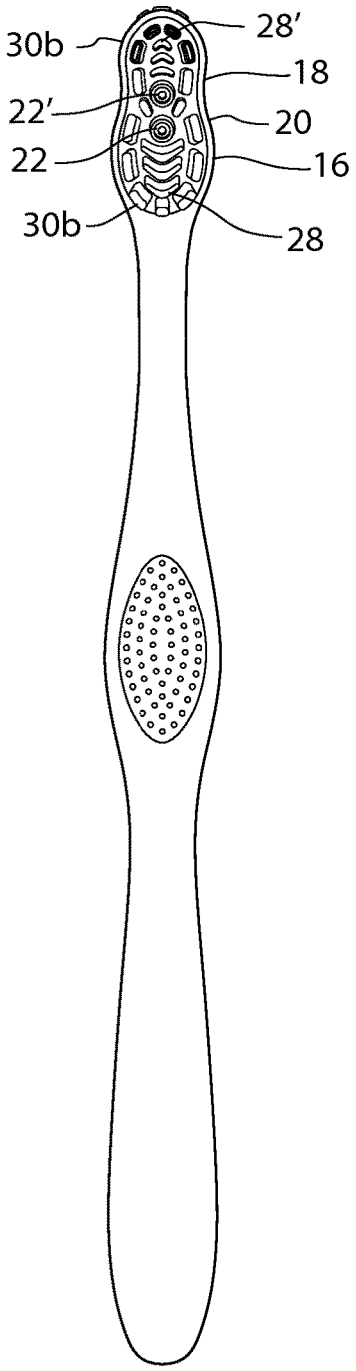
FIG. 7 illustrates a front view of the toothbrush of FIG. 6.
Figure 8A:
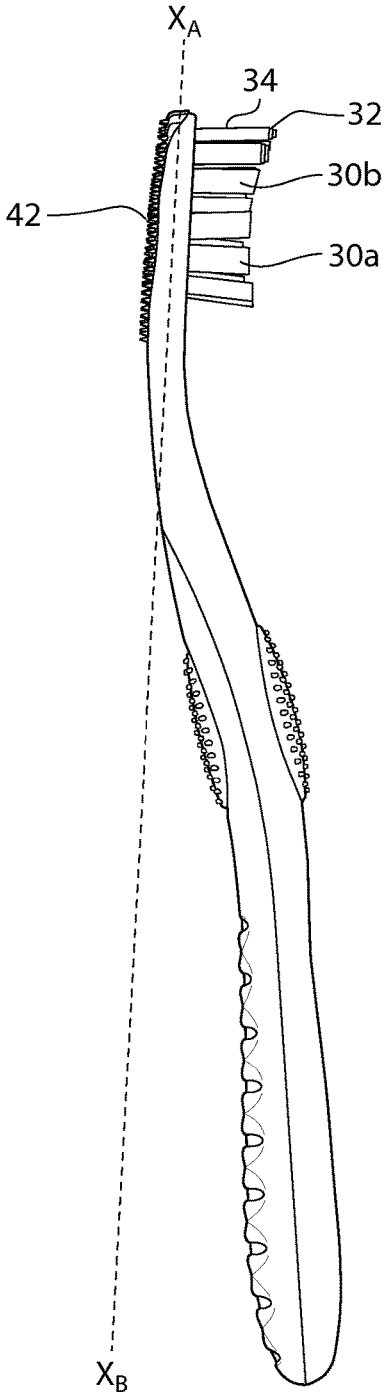
FIG. 8A illustrates the toothbrush of FIG. 6, viewed from the left-hand side thereof.
Figure 8B:
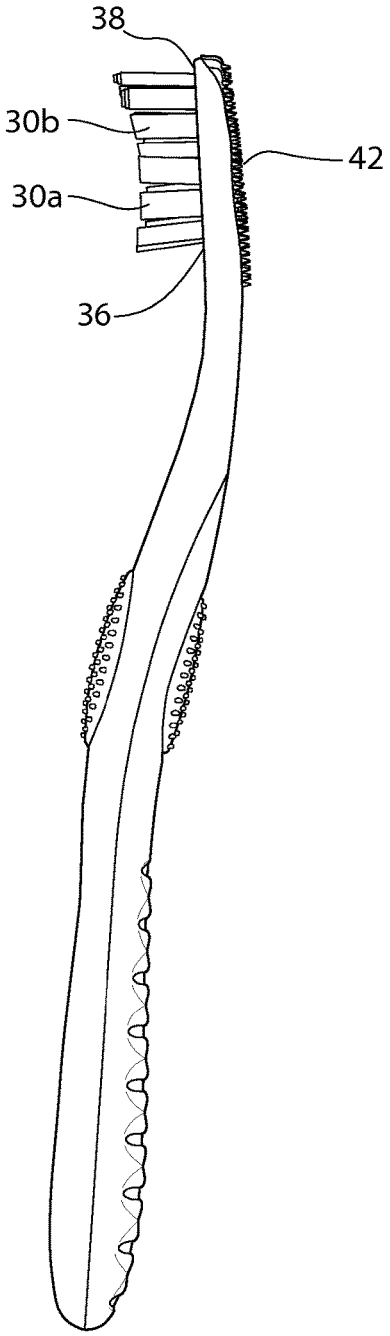
FIG. 8B illustrates the toothbrush of FIG. 6, viewed from the right-hand side thereof.
Figure 9A:
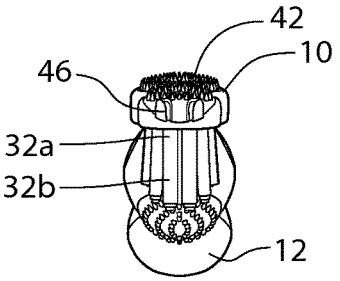
FIG. 9A illustrates a top view of the toothbrush of FIG. 8A, along the longitudinal axis $X_A$-$X_B$ of the head, looking in a direction from $X_A$ to $X_B$.
Figure 9B:
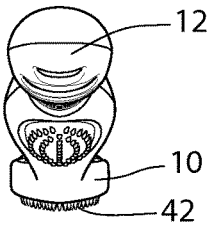
FIG. 9B illustrates a bottom view of the toothbrush of FIG. 8A, along the longitudinal axis $X_A$-$X_B$ of the head, looking in a direction from $X_B$ to $X_A$.
Figure 10:
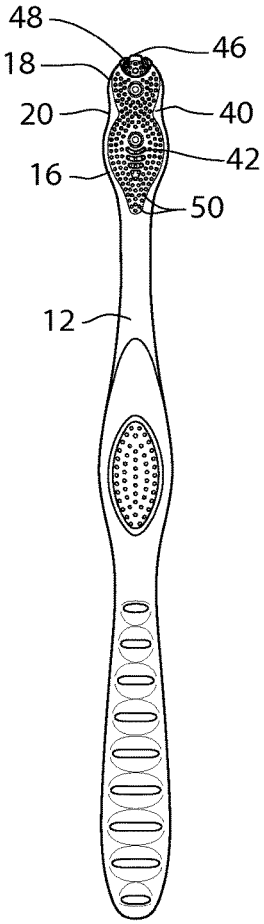
FIG. 10 illustrates a rear view of the toothbrush of FIG. 6.

The present invention provides an oral care implement comprising a head 10 and a handle 12, the head 10 comprising a first face 14 having a plurality of cleaning elements extending therefrom. The head 10 has a length in a direction along a longitudinal axis $X_1$-$X_2$ of the handle 12, and a width perpendicular to the length. This longitudinal axis $X_1$-$X_2$ is illustrated in FIG. 2, and is a longitudinal axis of the handle when the oral care implement is seen in plan view. In some embodiments, a plane containing a length and width of the handle is not co-planar with a plane containing the length and width of the head, when the oral care implement is viewed in side profile. The head 10 has a proximal section 16 adjacent to the handle 12 and a distal section 18 remote from the handle 12, the proximal section 16 having a first maximum width and the distal section 18 having a second maximum width. The second maximum width is less than the first maximum width. The distal section 18 and proximal section 16 are located adjacent to one another and are joined at a waist section 20, the waist section 20 having a third maximum width which is less than the second maximum width. The head of the oral care implement therefore has a "peanut-like" shape. The distal section 18 having a width which is less than the width of the proximal section 16 (i.e. the distal section 18 being narrower than the proximal section 16) provides for better access to the back teeth in the mouth, therefore providing effective cleaning.

The plurality of cleaning elements comprise at least one bristle tuft 22 having a distal end 24 remote from the first face 14, and the at least one bristle tuft 22 comprises bristles of varying lengths so as to form a cup-shaped recess 26 at the distal end 24 of the bristle tuft 22. The cup-shaped recess 26 at the distal end 24 of the at least one bristle tuft 22 conforms to the shape of the teeth and also holds toothpaste effectively, improving retention of toothpaste on the head 10 and thus providing effective cleaning.

In some embodiments, that at least one bristle tuft 22 is a cylindrical bristle tuft.

In some embodiments, the ratio of the first maximum width to the second maximum width is from 1.1:1 to 1.3:1, from 1.15:1 to 1.25:1, from 1.17:1 to 1.21:1, or about 1.19:1.

In some embodiments, the second maximum width is 11.3 mm to 13.3 mm, or from 11.8 mm to 12.8 mm. In some embodiments, the first maximum width is from 13.5 mm to 15.7 mm, or from 14.0 mm to 15.2 mm. In some embodiments, the second maximum width is from 11.8 mm to 12.8 mm and the first maximum width is from 14.0 mm to 15.2 mm. The oral care implement therefore has an overall narrower head geometry than that of previous implements known in the art.

In certain embodiments, the at least one bristle tuft 22 is positioned on a longitudinal axis of the head 10. In some embodiments, the plurality of cleaning elements further comprises at least one cleaning element 28 which is substantially V-shaped in plan, and which has a concave side facing towards the bristle tuft 22. In some embodiments, the oral care implement comprises a plurality of said cleaning elements 28 which are substantially V-shaped in plan, positioned in series on the longitudinal axis of the head 10 wherein the concave side of each said cleaning element 28 faces towards the bristle tuft 22. The V-shaped cleaning elements 28 provide directional cleaning/scrubbing of tooth surfaces, thus increasing cleaning efficacy of the oral care implement.

In certain embodiments, each of the plurality of V-shaped cleaning elements 28 has a height, wherein the height of successive V-shaped cleaning elements 28 in the series increases with an increase in distance of the V-shaped cleaning elements 28 from the bristle tuft 22. The difference in height of successive V-shaped cleaning elements 28 in the series provides multi-level cleaning, thus improving cleaning efficacy. In some embodiments, each V-shaped cleaning element 28 has a height which is consistent along its extension across the width of the head 10. In some embodiments, each V-shaped cleaning element 28 has a height which decreases upon its extension across the width of the head 10 away from the longitudinal axis of the head 10. The difference in height across each V-shaped cleaning element 28 also provides multi-level cleaning and the tallest point of the V reaches further back in the mouth, thus improving cleaning efficacy.

In some embodiments, each of the plurality of V-shaped cleaning elements 28 is formed from an array of bristles.

In some embodiments, the oral care implement further comprises peripheral bristles 30 positioned towards an outer edge of the first face 14 of the head 10.

In certain embodiments, the peripheral bristles 30 have a height which increases with distance from the waist section 20. This increase in height provides for improved cleaning along the gumline.

In some embodiments, at any given distance from the waist section 20 along the length of the head 10, the height of the peripheral bristles 30 is greater than the height of an adjacent one of the V-shaped cleaning elements 28. The provision of the taller peripheral bristles 30 provides improved cleaning along the gumline.

In some embodiments, the peripheral bristles 30 include a terminal bristle tuft 32 positioned at a distal-most end of the distal section 18, wherein a distal-most surface 34 of the terminal bristle tuft 32 forms an angle α of from 80° to 89° or of from 84° to 87° with a longitudinal axis $X_A$-$X_B$ of the head 10. In some embodiments, the angle α is about 86°. Providing the angle α between the distal-most surface 34 of the terminal bristle tuft 32 and the longitudinal axis $X_A$-$X_B$ of the head 10 provides for improved cleaning. In some embodiments, the peripheral bristles 30 include two terminal bristle tufts 32 adjacent to one another, one on each side of the longitudinal axis $X_A$-$X_B$ of the head 10.

In some embodiments, the height of the at least one bristle tuft 22 is less than the height of the peripheral bristles 30 adjacent thereto.

In certain embodiments, the height of successive peripheral bristle tufts increases with their distance from the waist section 20. In some embodiments, the peripheral bristles 30 comprise a plurality of peripheral bristle tufts. In certain embodiments, each peripheral bristle tuft has a height which is consistent along the extension of the peripheral bristle tuft along the head.

In some embodiments, the height of each peripheral bristle tuft increases along its extension along the head in a direction away from the waist section 20, so that distal ends of the peripheral bristle tufts (i.e. remote from the first face 14) form a concave profile from the waist section to a distal-most end 38 of the head 10, when viewed from the side of the oral care implement. In some embodiments, the height of each peripheral bristle tuft increases along its extension along the head in a direction away from the waist section 20, so that distal ends of the peripheral bristle tufts (i.e. remote from the first face 14) form a concave profile from the waist section 20 to a proximal-most end 36 of the head 10, when viewed from the side of the oral care implement.

In certain embodiments, the oral care implement comprises a first bristle tuft 22 positioned on a longitudinal axis $X_A$-$X_B$ of the head 10 in the proximal section 16 of the head 10, and a second bristle tuft 22' positioned on a longitudinal axis $X_A$-$X_B$ of the head 10 in the distal section 18 of the head 10. Each of the first and second bristle tufts have a distal end remote from the first face, and each of the first and second bristle tufts comprise bristles of varying lengths so as to form a cup-shaped recess at the distal end of each of the first and second bristle tufts. These cup-shaped recesses provide more scrubbing of the teeth, and conform to the shape of the teeth and also hold toothpaste effectively, improving retention of toothpaste on both the proximal and distal sections of the head 10 and thus providing effective cleaning.

In some embodiments, the first bristle tuft 22 is a cylindrical bristle tuft. In some embodiments, the second bristle tuft 22' is a cylindrical bristle tuft. In some embodiments, both the first and second bristle tufts 22, 22' are cylindrical bristle tufts.

In some embodiments, the oral care implement comprises a first plurality of cleaning elements 28 which are substantially V-shaped in plan, positioned in series on the longitudinal axis $X_A$-$X_B$ of the head 10 in the proximal section 16, wherein each of said first plurality of V-shaped cleaning elements 28 has a concave side facing towards the first bristle tuft 22. In some embodiments, the first bristle tuft 22 is positioned towards the waist section 20 and the first plurality of V-shaped cleaning elements 28 are positioned between the first bristle tuft 22 and a proximal-most end 36 of the head 10. The V-shaped cleaning elements 28 provide directional cleaning/scrubbing of tooth surfaces, thus increasing cleaning efficacy.

In some embodiments, the oral care implement comprises a second plurality of cleaning elements 28' which are substantially V-shaped in plan, positioned in series on the longitudinal axis $X_A$-$X_B$ of the head 10 in the distal section 18, wherein each of said second plurality of V-shaped cleaning elements 28' has a concave side facing towards the second bristle tuft 22' In some embodiments, the second bristle tuft 22' is positioned towards the waist section 20 and the second plurality of V-shaped cleaning elements 28' are positioned between the second bristle tuft 22' and a distal-most end 38 of the head 10.

In some embodiments, each of the first plurality of V-shaped cleaning elements 28 has a height, wherein the height of successive V-shaped cleaning elements in the series increases with an increase in distance of the first plurality of V-shaped cleaning elements 28 from the first bristle tuft 22. In some embodiments, each of the second plurality of V-shaped cleaning elements 28' has a height, wherein the height of successive V-shaped cleaning elements in the series increases with an increase in distance of the second plurality of V-shaped cleaning elements 28' from the second bristle tuft 22'.

The differing heights of the V-shaped cleaning elements 28, 28' in the respective series allow for increased ease of reach of areas at the back of the mouth for cleaning/scrubbing, and also provide a different mouthfeel to that given by oral care implements in which the bristles are of uniform height In some embodiments, the oral care implement comprises the first plurality of V-shaped cleaning elements 28 and the second plurality of V-shaped cleaning elements 28', wherein the height of each of the second plurality of V-shaped cleaning elements 28' is greater than the height of a corresponding one of the first plurality of V-shaped cleaning elements 28. In some embodiments, each V-shaped cleaning element 28, 28' has a height which is consistent along its extension across the width of the head 10. In some embodiments, each V-shaped cleaning element 28, 28' has a height which decreases upon its extension across the width of the head 10 away from the longitudinal axis $X_A$-$X_B$ of the head 10.

In some embodiments, each of the plurality of V-shaped cleaning elements 28, 28' is formed from an array of bristles.

In some embodiments, the oral care implement further comprises peripheral bristles 30 positioned towards an outer edge of the first face 14 of the head 10. In some embodiments, the peripheral bristles 30 have a height which increases with distance from the waist section 20. In some embodiments, at any given distance from the waist section 20 along the length of the head 10, the height of the peripheral bristles 30 is greater than the height of an adjacent one of the V-shaped cleaning elements 28, 28'. In some embodiments, the height of the first and second bristle tufts 22, 22' is less than the height of the peripheral bristles 30 adjacent thereto.

In some embodiments, the peripheral bristles 30 include a terminal bristle tuft 32 positioned at a distal-most end 38 of the distal section 18, wherein a distal-most surface 34 of the terminal bristle tuft 32 forms an angle α of from 80° to 89° or of from 84° to 87° with a longitudinal axis of the head. In some embodiments, the angle α is about 86°. In some embodiments, the peripheral bristles 30 include two terminal bristle tufts 32 adjacent to one another, one on each side of the longitudinal axis $X_A$-$X_B$ of the head 10.

In some embodiments, the height of the first and second bristle tufts 22, 22' is less than the height of the peripheral bristles 30 adjacent thereto.

In some embodiments, the oral care implement comprises first 22 and second 22' bristle tufts, first 28 and second 28' pluralities of V-shaped cleaning elements, and first 30 and second 30' pluralities of peripheral bristles, the first plurality of peripheral bristles 30 being positioned on the proximal section 16 of the head 10 and the second plurality of peripheral bristles 30' being positioned on the distal section 18 of the head 10. In some embodiments, the first plurality of peripheral bristles 30 and the second bristle tuft 22' are positioned on the head 10 so as to form a first teardrop-shaped pattern when seen in plan view. In some embodiments, the second plurality of peripheral bristles 30' and the first bristle tuft 22 are positioned on the head 10 so as to form a second teardrop-shaped pattern when seen in plan view. In some embodiments, the first teardrop-shaped pattern and the second teardrop-shaped pattern are interlocked when seen in plan view.

In some embodiments, the first plurality of peripheral bristles 30 comprises a first plurality of peripheral bristle tufts 30*a* and the second plurality of peripheral bristles 30' comprises a second plurality of peripheral bristle tufts 30*b*. In certain embodiments, the height of successive first peripheral bristle tufts 30*a* increases with their distance from the second bristle tuft 22', and the height of successive second peripheral bristle tufts 30*b* increases with their distance from the first bristle tuft 22. In certain embodiments, each peripheral bristle tuft 30*a*, 30*b* has a height which is consistent along the extension of the peripheral bristle tuft 30*a*, 30*b* along the head.

In some embodiments, the height of each first peripheral bristle tuft 30*a* increases along its extension along the head in a direction away from the second bristle tuft 22', and the height of successive first peripheral bristle tufts 30*a* increases with distance from the second bristle tuft 22' so that distal ends of the plurality of first peripheral bristle tufts 30*a* (i.e. remote from the first face 14) form a concave profile when viewed from the side of the oral care implement. In some embodiments, the height of each second peripheral bristle tuft 30*b* increases along its extension along the head in a direction away from the first bristle tuft 22, and the height of successive second peripheral bristle tufts 30*b* increases with distance from the first bristle tuft 22 so that distal ends of the plurality of second peripheral bristle tufts 30*b* (i.e. remote from the first face 14) form a concave profile when viewed from the side of the oral care implement.

In some embodiments, the oral care implement further comprises a second face 40 located on an opposite side of the head 10 to the first face 14, wherein the second face 40 comprises a tissue cleanser 42. In some embodiments, the tissue cleanser 42 comprises a plurality of nubs.

In some embodiments, the tissue cleanser 42 extends over a distal-most edge 44 of the head 10.

In some embodiments, the tissue cleanser 42 forms a ridge 46 on the distal-most edge 44 of the head 10. This provides a cushioning effect when reaching to clean the back teeth using the oral care implement.

In some embodiments, the at least one ridge 46 extends across the distal-most edge 44 of the head 10 in a direction parallel to the width of the head 10.

In some embodiments, the ridge 46 comprises at least one notch 48 which divides the ridge 46 into a plurality of sections across the width of the distal-most edge 44 of the head 10.

In some embodiments, the tissue cleanser 42 extends past the proximal-most end 36 of the head along a portion of the handle 12. This provides greater exfoliation and a different mouth sensation on the lips.

The tissue cleanser 42 may be fixed to the second face 40 by any method known in the art. The tissue cleanser 42 may be made of an elastomeric material.

The head 10 and handle 12 may be formed of polypropylene.

The cleaning elements may be fixed to the head by any suitable method. In some embodiments, the cleaning elements are attached to a bristle plate by anchor-free tufting (AFT), and the bristle plate is then attached to the head.

FIGS. 1 to 10 show a toothbrush in accordance with an embodiment of the present invention. This toothbrush includes a head 10 and a handle 12, wherein the head comprises a first face 14 having a plurality of cleaning elements extending therefrom. The head also comprises a second face 40 located on an opposite side of the head 10 to the first face 14. The second face 40 comprises a tissue cleanser 42, which will be discussed in more detail below.

The head has a proximal section 16 adjacent to the handle, and a distal section 16 remote from the handle 12. The proximal section 16 has a maximum width $W_1$ and the distal section has a maximum width $W_2$, wherein $W_2$ is less than $W_1$. The ratio of $W_1$:$W_2$ is approximately 1.19:1. The proximal section 16 and the distal section 18 are located adjacent to one another and are joined by a waist section 20, which has a maximum width which is less than the maximum width $W_2$ of the distal section 18.

The plurality of cleaning elements comprises a first cylindrical bristle tuft 22 positioned on a longitudinal axis of the head 10 towards the waist section 20 in the proximal section 16 of the head 10, and a second cylindrical bristle tuft 22' positioned on a longitudinal axis of the head 10 towards the waist section 20 in the distal section 18 of the head 10. The cylindrical bristle tufts 22, 22' each comprise bristles of varying lengths so as to form a cup-shaped recess 26 at the distal end of each cylindrical bristle tuft 22, 22' (i.e. the end remote from the first face 14).

The toothbrush also comprises first and second pluralities of cleaning elements 28, 28' which are substantially V-shaped in plan. The first plurality of V-shaped cleaning elements 28 are positioned in series on the longitudinal axis of the head 10 in the proximal section 16, between the first cylindrical bristle tuft 22 and a proximal-most end 36 of the head 10, and each of the first plurality of cleaning elements 28 has a concave side facing towards the first cylindrical bristle tuft 22. The second plurality of V-shaped cleaning elements 28' are positioned in series on the longitudinal axis of the head 10 in the distal section 18, between the second cylindrical bristle tuft 22' and a distal-most end 38 of the head 10, and each of the second plurality of V-shaped cleaning elements has a concave side facing towards the second cylindrical bristle tuft 22'. The height of successive V-shaped cleaning elements 28, 28' in each series increases with an increase in distance of the first and second pluralities of V-shaped cleaning elements 28, 28' from the first and second cylindrical bristle tufts 22, 22', respectively. Each of the V-shaped cleaning elements is formed from an array of bristles.

The toothbrush also comprises a first plurality of peripheral bristle tufts 30*a* positioned towards an outer edge of the first face 14 on the proximal section 16 of the head 10, and a second plurality of peripheral bristle tufts 30*b* positioned towards an outer edge of the first face 14 on the distal section 18 of the head 10. The first plurality of peripheral bristle tufts 30*a* and the second cylindrical bristle tuft 22' are positioned on the head 10 so as to form a first teardrop-shaped pattern when seen in plan view. The second plurality of peripheral bristle tufts 30*b* and the first cylindrical bristle tuft 22 are positioned on the head 10 so as to form a second teardrop-shaped pattern when seen in plan view. When viewed in plan, the first teardrop-shaped pattern and the second teardrop-shaped pattern are interlocked. At any given distance from the waist section 20 along the length of the head 10, the height of the peripheral bristle tufts 30*a*, 30*b* is greater than the height of an adjacent one of the V-shaped cleaning elements 28, 28'.

The height of successive first peripheral bristle tufts 30*a* increases with their distance from the second cylindrical bristle tuft 22', and the height of successive second peripheral bristle tufts 30*b* increases with their distance from the second cylindrical bristle tuft 22. The height of the first and second cylindrical bristle tufts 22, 22' is less than the height of the peripheral bristle tufts 30*a*, 30*b* adjacent thereto.

The height of each first peripheral bristle tuft 30*a* increases along its extension along the head 10 in a direction away from the second cylindrical bristle tuft 22'. The height of successive first peripheral bristle tufts 30*a* increases with distance from the second cylindrical bristle tuft 22' so that the distal ends of the first peripheral bristle tufts 30*a* (i.e. remote from the first face 14) form a concave profile when viewed from the side of the toothbrush.

The second plurality of peripheral bristle tufts 30*b* includes two distal-most bristle tufts positioned adjacent to one another, one on either side of the longitudinal axis of the head 10, at a distal-most end 38 of the head 10. The two distal-most bristle tufts have a height which is consistent along the extension of these bristle tufts along the head. The two peripheral bristle tufts which are immediately adjacent to the two distal-most bristle tufts also have a height which is consistent along the extension of these peripheral bristle tufts along the head. Other bristle tufts of the second plurality of peripheral bristle tufts 30*b* each have a height which increases along the extension of these peripheral bristle tufts 30*b* along the head 10 in a direction away from the first cylindrical bristle tuft 22, so that distal ends of these peripheral bristle tufts 30*b* (i.e. remote from the first face 14) form a concave profile when viewed from the side of the toothbrush.

As mentioned above, the second face 40 of the head 10 comprises a tissue cleanser 42. The tissue cleanser 42 includes a plurality of nubs 50 for cleansing soft tissue of the mouth, including the tongue. The tissue cleanser 42 extends over a distal-most edge 44 of the head 10. The portion of the tissue cleanser 42 which extends over the distal-most edge 44 forms a ridge 46 which extends across the distal-most edge 44 in a direction parallel to the width of the head 10. The ridge 46 is divided into three sections by the presence of two notches 48, which notches extend along the portion of the tissue cleanser which is disposed on the distal-most edge 44 of the head.

The tissue cleanser 42 also extends past the proximal-most end 36 of the head 10 along a portion of the handle 12.

FIGS. 11 to 14 show a toothbrush in accordance with another embodiment of the present invention. This toothbrush is similar to that shown in FIGS. 1 to 10, differing only in terms of the arrangements of lengths of the first and second peripheral bristle tufts 30*a*, 30*b*.

Figure 11:
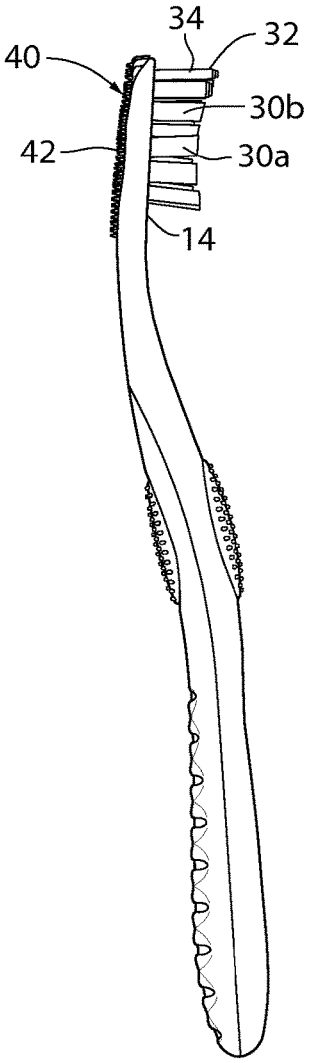
FIG. 11 illustrates a side view of another toothbrush in accordance with another embodiment of the present invention, wherein the peripheral bristles have an arrangement of lengths which is different to that shown in FIGS. 1 to 10.
Figure 12:
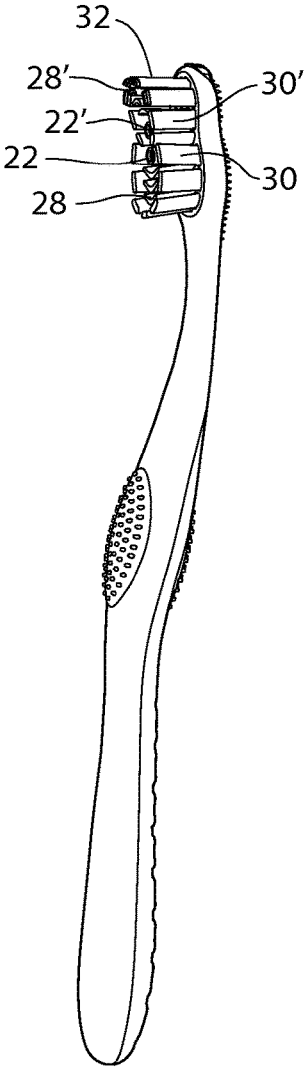
FIG. 12 illustrates the toothbrush of FIG. 11, shown in perspective view.
Figure 13:
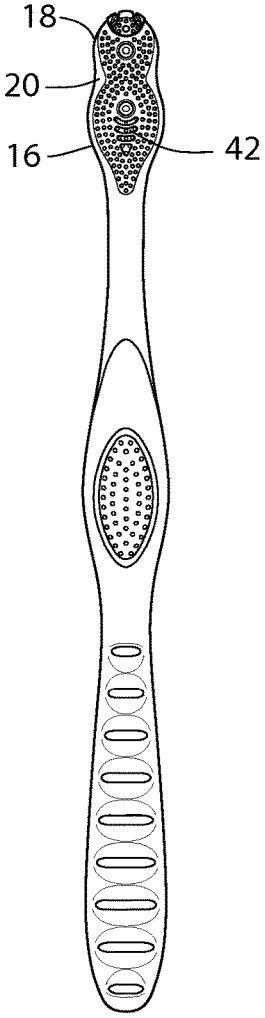
FIG. 13 illustrates a rear view of the toothbrush of FIG. 11.
Figure 14:
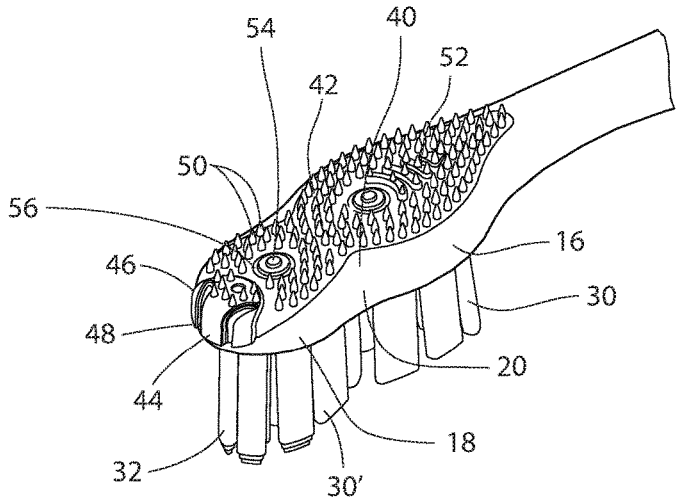
FIG. 14 illustrates a perspective view of the head of the toothbrush shown in FIGS. 11 to 13, showing the tissue cleanser on the second face thereof.

In the toothbrush shown in FIGS. 11 and 12, the height of each first peripheral bristle tuft 30*a* increases along its extension along the head in a direction away from the second cylindrical bristle tuft 22', and the height of successive peripheral bristle tufts 30*a* increases with distance from the second cylindrical bristle tuft 22' so that distal ends of the bristle tufts 30*a* (i.e. remote from the first face 14) form a concave profile when viewed from the side of the oral care implement. The height of each second peripheral bristle tuft 30*b* also increases along its extension along the head in a direction away from the first cylindrical bristle tuft 22, and the height of successive peripheral bristle tufts 30*b* increases with distance from the first cylindrical bristle tuft 22 so that distal ends of the peripheral bristle tufts 30*b* (i.e. remote from the first face 14) form a concave profile when viewed from the side of the oral care implement.

Figure 15:
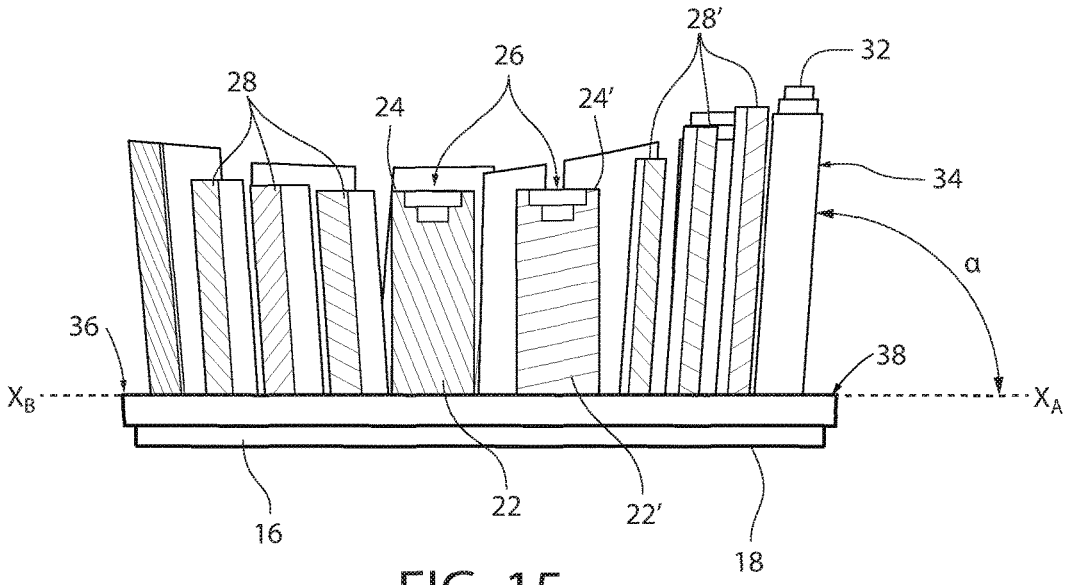
FIG. 15 illustrates a side profile view of a bristle plate configured to be received on the head of a toothbrush in accordance with the present invention, with the peripheral bristles omitted from the side of the head so as to show the arrangement of the first and second bristle tufts, the first and second pluralities of V-shaped cleaning elements, and the terminal bristle tuft of the peripheral bristles.

FIG. 15 shows a side profile view of a bristle plate configured to be received on the head 10 of a toothbrush in accordance with the present invention, with the peripheral bristles omitted from the side thereof, as discussed above. The bristle plate may be utilized in toothbrushes in which the bristles/cleaning elements are attached for example by anchor-free tufting (AFT) technology rather than by anchors (i.e. stapling).

The bristle plate includes a proximal section 16 configured to be adjacent to the handle and a distal section 16 configured to be remote from the handle when the plate is received on the head of a toothbrush. The proximal section 16 and the distal section 18 are located adjacent to one another and are joined at a waist section 20. The proximal section 16 has a first maximum width, the distal section 18 has a second maximum width, and the waist section 20 has a third maximum width. The second maximum width is less than the first maximum width, and the third maximum with is less than the second maximum width. The bristle plate comprises a plurality of cleaning elements, which cleaning elements comprise a first cylindrical bristle tuft 22 positioned on a longitudinal axis of the bristle plate towards the waist section 20 in the proximal section 16, and a second cylindrical bristle tuft 22' positioned on a longitudinal axis of the bristle plate towards the waist section 20 in the distal section 18. The cylindrical bristle tufts 22, 22' each comprise bristles of varying lengths so as to form a cup-shaped recess 26 at the distal end of each cylindrical bristle tuft 22, 22'. The longitudinal axis of the bristle plate corresponds to a longitudinal axis of the head upon which the bristle plate is configured to be received.

The bristle plate also comprises first and second pluralities of cleaning elements 28, 28' which are substantially V-shaped in plan. The first plurality of V-shaped cleaning elements 28 are positioned in series on the longitudinal axis of the bristle plate in the proximal section 16, between the first cylindrical bristle tuft 22 and a proximal-most end 36 of the proximal section 16, and each of the first plurality of cleaning elements 28 has a concave side facing towards the first cylindrical bristle tuft 22. The second plurality of V-shaped cleaning elements 28' are positioned in series on the longitudinal axis of the bristle plate in the distal section 18, between the second cylindrical bristle tuft 22' and a distal-most end 38 of the distal section 18, and each of the second plurality of V-shaped cleaning elements has a concave side facing towards the second cylindrical bristle tuft 22'. The height of successive V-shaped cleaning elements 28, 28' in each series increases with an increase in distance of the first and second pluralities of V-shaped cleaning elements 28, 28' from the first and second cylindrical bristle tufts 22, 22', respectively. Each of the V-shaped cleaning elements is formed from an array of bristles. The height of each of the second plurality of V-shaped cleaning elements 28' is greater than the height of a corresponding one of the first plurality of V-shaped cleaning elements 28.

The bristle plate also comprises peripheral bristles positioned towards an outer edge of the bristle plate, which peripheral bristles include a terminal bristle tuft 32 positioned at a distal-most end of the distal section 18. The distal-most surface 34 of the terminal bristle tuft 32 forms an angle of about 86° with the longitudinal axis of the bristle plate.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising a head and a handle, the head comprising a first face having a plurality of cleaning elements extending therefrom, wherein the head has a length in a direction along a longitudinal axis of the handle, and a width perpendicular to the length, the head having a proximal section adjacent to the handle and a distal section remote from the handle, the proximal section having a first maximum width and the distal section having a second maximum width, wherein the second maximum width is less than the first maximum width, wherein the distal section and proximal section are located adjacent to one another and are joined at a waist section, the waist section having a third maximum width which is less than the second maximum width, the plurality of cleaning elements comprising:

a first bristle tuft positioned on a longitudinal axis of the head in the proximal section of the head and a second bristle tuft positioned on a longitudinal axis of the head in the distal section of the head, wherein each of the first and second bristle tufts have a distal end remote from the first face, and wherein each of the first and second bristle tufts comprise bristles of varying lengths so as to form a cup-shaped recess at the distal end of each of the first and second bristle tufts;

a first plurality of cleaning elements which are substantially V-shaped in plan positioned in series on the longitudinal axis of the head in the proximal section, wherein each of said first plurality of cleaning elements has a concave side facing towards the first bristle tuft, wherein the first bristle tuft is positioned towards the waist section and the first plurality of cleaning elements are positioned between the first bristle tuft and a proximal-most end of the head;

a second plurality of cleaning elements which are substantially V-shaped in plan positioned in series on the longitudinal axis of the head in the distal section, wherein each of said second plurality of cleaning elements has a concave side facing towards the second bristle tuft, wherein the second bristle tuft is positioned towards the waist section and the second plurality of cleaning elements are positioned between the second bristle tuft and a distal-most end of the head;

peripheral bristles positioned towards an outer edge of the first face of the head, the peripheral bristles comprising a first plurality of peripheral bristles positioned on the proximal section of the head and a second plurality of peripheral bristles positioned on the distal section of the head, wherein the first plurality of peripheral bristles and the second bristle tuft are positioned on the head so as to form a first teardrop-shaped pattern when seen in plan view, and wherein the second plurality of peripheral bristles and the first bristle tuft are positioned on the head so as to form a second teardrop-shaped pattern when seen in plan view; and wherein the first teardrop-shaped pattern and the second teardrop-shaped pattern are interlocked when seen in plan view.

2. The oral care implement of claim 1, wherein the first and second bristle tufts are cylindrical.

3. The oral care implement of claim 1, wherein a ratio of the first maximum width to the second maximum width is from 1.17:1 to 1.21:1.

4. The oral care implement of claim 1, wherein the second maximum width is from 11.8 mm to 12.8 mm.

5. The oral care implement of claim 1, wherein each of the first plurality of cleaning elements has a height, wherein the height of successive ones of the first plurality of cleaning elements in the series increases with an increase in distance of first plurality of cleaning elements from the first bristle tuft.

6. The oral care implement of claim 1 wherein the peripheral bristles have a height which increases with distance from the waist section, and wherein, at any given distance from the waist section along the length of the head, the height of the peripheral bristles is greater than the height of an adjacent one of the first and second pluralities of cleaning elements.

7. The oral care implement claim 1, wherein the peripheral bristles include a terminal bristle tuft positioned at a distal-most end of the distal section, wherein a distal-most surface of the terminal bristle tuft forms an angle of from 80° to 89° with the longitudinal axis of the head.

8. The oral care implement of claim 1, wherein the peripheral bristles comprise a plurality of peripheral bristle tufts, wherein a height of each peripheral bristle tuft increases along its extension along the head in a direction away from the waist section so that distal ends of successive peripheral bristle tufts form a concave profile from the waist section to a distal-most end of the head, when viewed from the side of the oral care implement.

9. The oral care implement of claim 8, wherein the height of each peripheral bristle tuft increases along its extension along the head in a direction away from the waist section so that distal ends of successive peripheral bristle tufts form a concave profile from the waist section to a proximal-most end of the head, when viewed from the side of the oral care implement.

10. The oral care implement of claim 1, wherein a height of the first and second bristle tufts is less than a height of the peripheral bristles adjacent thereto.

11. The oral care implement of claim 1, wherein the first plurality of peripheral bristles comprises a first plurality of peripheral bristle tufts and the second plurality of peripheral bristles comprises a second plurality of peripheral bristle tufts.

12. The oral care implement of claim 11, wherein a height of successive ones of the first plurality of peripheral bristle tufts increases with their distance from the second bristle tuft, and a height of successive ones of the second plurality of peripheral bristle tufts increases with their distance from the first bristle tuft.

13. The oral care implement of claim 1, further comprising a second face located on an opposite side of the head to the first face, wherein the second face comprises a tissue cleanser, and wherein the tissue cleanser extends past a proximal-most end of the head along a portion of the handle.

* * * * *